US005480264A

United States Patent [19]

Hunter

[11] Patent Number: 5,480,264

[45] Date of Patent: Jan. 2, 1996

[54] OFFSHORE PIPELINE SYSTEM

[75] Inventor: Andrew F. Hunter, Houston, Tex.

[73] Assignee: Imodco, Inc., Calabasas Hills, Calif.

[21] Appl. No.: 302,349

[22] Filed: Sep. 7, 1994

[51] Int. Cl.[6] ..... F16L 1/12

[52] U.S. Cl. ..... 405/195.1; 405/169

[58] Field of Search ..... 405/169, 158, 405/168.1, 171, 195.1, 223.1, 224, 229.2, 229.3, 229.4

[56] References Cited

U.S. PATENT DOCUMENTS

| | | | |
|---|---|---|---|
| 3,226,728 | 12/1965 | Walvoord . | |
| 3,650,114 | 3/1972 | Neal . | |
| 3,658,366 | 4/1972 | Welch . | |
| 3,724,224 | 4/1973 | Matthews . | |
| 3,727,954 | 4/1973 | Oliver . | |
| 3,955,599 | 5/1976 | Walker . | |
| 4,098,091 | 7/1978 | Desai et al. | 405/195.1 X |
| 4,182,584 | 1/1980 | Panicker | 405/224.3 |
| 4,263,004 | 4/1981 | Joubert et al. | 405/171 X |
| 4,400,110 | 8/1983 | Beynet et al. | 405/224.2 |
| 4,462,717 | 7/1984 | Falcimaigne | 405/224.3 |
| 4,478,586 | 10/1984 | Gentry . | |
| 4,523,877 | 6/1985 | Finn et al. | 405/224.2 X |
| 4,666,339 | 5/1987 | Pollack | 405/224 X |
| 4,673,313 | 6/1987 | Baugh . | |
| 4,702,647 | 10/1987 | Esparza | 405/195.1 X |
| 4,704,050 | 11/1987 | Wallace | 405/224.2 |
| 4,735,267 | 4/1988 | Stevens | 405/224 X |
| 5,269,629 | 12/1993 | Langner | 405/195.1 |
| 5,275,510 | 1/1994 | de Baan et al. | 405/171 |
| 5,354,151 | 10/1994 | Giannesini | 405/224.3 X |

FOREIGN PATENT DOCUMENTS

| | | | |
|---|---|---|---|
| 0214404 | 8/1990 | Japan | 405/158 |
| 2099894 | 12/1982 | United Kingdom | 405/169 |
| 2153332 | 8/1985 | United Kingdom | 405/169 |

*Primary Examiner*—Ramon S. Britts
*Assistant Examiner*—Frederick L. Lagman
*Attorney, Agent, or Firm*—Freilich Hornbaker Rosen

[57] ABSTRACT

An offshore fluid transfer system is described, for transferring fluid between stations (12, 14, FIG. 1) that may be many kilometers apart and lie in deep water, which avoids the need for making fluid connections at great underwater depths. A buoy station (14) includes a buoy (40) anchored to the seafloor to lie a moderate distance below the sea surface, and coupled through a flexible hose (46) to a turret (52) that is attached to a weathervaning vessel (30) and that is anchored to the seafloor. A major conduit portion (34) which extends between the first station and the buoy, includes a long pipeline of series-connected steel pipes that extends along the seafloor to near the buoy station, with an end portion (32) of the pipeline extending in a J-curve and in a primarily upward direction to the underwater buoy.

6 Claims, 2 Drawing Sheets

OFFSHORE PIPELINE SYSTEM

BACKGROUND OF THE INVENTION

It is sometimes necessary to connect a pair of offshore stations spaced many kilometers apart, to transfer fluid between them. In one example, oil wells are located 30 kilometers apart and oil from the wells must be transferred to a common vessel located in a sea location of a depth of a plurality of hundreds of meters. A turret coupled to the vessel is held in approximate location by catenary chains, and the vessel can weathervane and shift position to a limited extent. A steel pipeline can extend most of the distance along the lo seafloor between stations, but near the vessel other means must be provided to couple the steel pipeline to the vessel turret. Often, a buoy is provided that is anchored to a base at the seafloor, which holds the buoy perhaps 100 meters below the sea surface where it is isolated from most wave action, and a flexible hose extends between the buoy and the turret. The pipeline extends along the seafloor to the base and a vertical pipe extends from the base to the buoy.

While the above system is reliable, it requires fluid connections near the seafloor, where the end of the pipeline connects to the bottom of the vertical pipe that extends up to the buoy. At greater depths it becomes increasingly difficult to send divers to the seafloor to make connections. A fluid connection system for great depths, which avoided the need to make connections at great depths, would be of value.

SUMMARY OF THE INVENTION

In accordance with one embodiment of the present invention, an offshore fluid transfer system is provided for use in deep waters, which can avoid the need for fluid connections to be made at great depth. The system includes first and second stations connected by a conduit that extends largely along the seafloor, where one of the stations is a buoy station that includes a buoy anchored so it lies underwater but closer to the sea surface than the seafloor. The buoy is coupled to a seasurface structure that floats at the sea surface and that is loosely anchored to the seafloor to enable drift, the conduit including a flexible hose that extends between the buoy and the seasurface structure. The main conduit portion includes a long pipeline formed of steel pipes, which extends along the seafloor to near the buoy station, and in a J-curve up to the buoy. By extending the steel pipeline in a J-curve to the buoy, instead of to the bottom of a vertical pipe that extends up to the buoy, applicant avoids the need to make fluid connections at a great depth.

To minimize movement of the buoy, applicant prefers to use at least two, and preferably three anchor lines extending from the buoy to the seafloor. The anchor lines stiffen the buoy anchorage against horizontal movement to minimize flexing of the pipeline.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
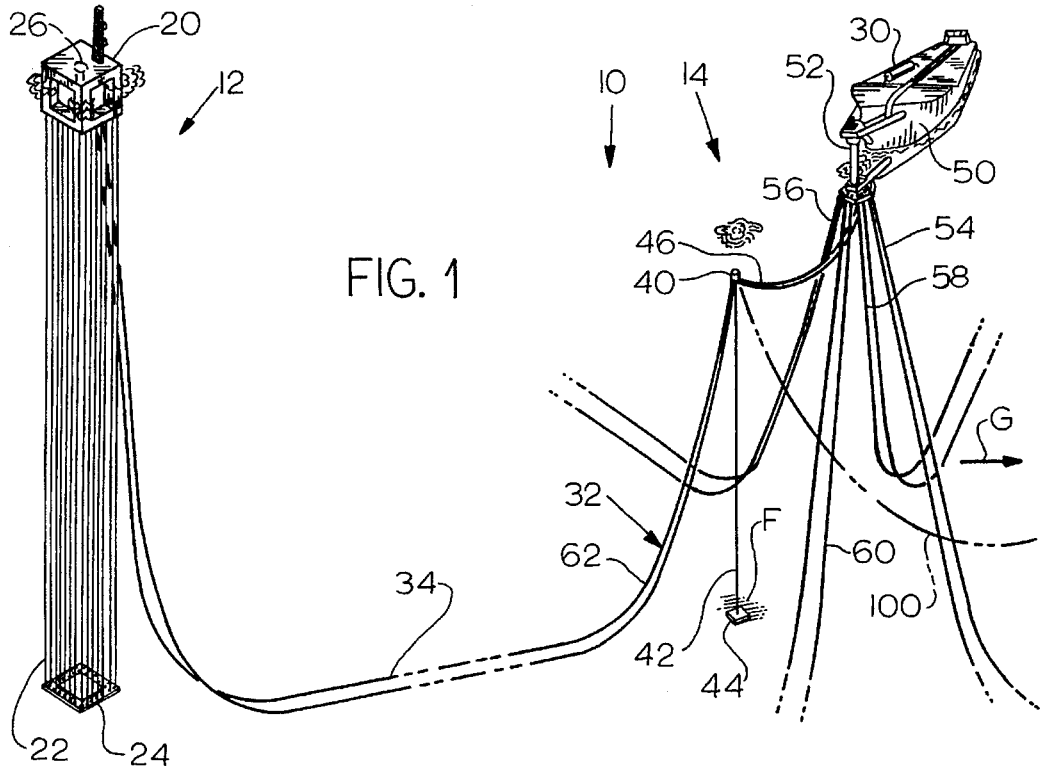
FIG. 1 is a perspective view of an offshore fluid transfer system constructed in accordance with one embodiment of the invention, and showing, in phantom lines, a second buoy anchor arrangement.

FIG. 1 illustrates an offshore fluid transfer system 10 which includes first and second stations 12, 14 located in deep water having a depth of a plurality of hundreds of meters. The first station 12 is a tension leg platform station or TAP station, which includes a platform 20 that floats at the sea surface and that is coupled by tension lines 22 to a well template 24 at the seafloor. Hydrocarbon wells at the well template 24 are connected through pipes to a tree 26 on the platform. The particular platform 20 is relatively small, without crew quarters, with a width, length, and depth each about 30 meters, and with a displacement of about 6,000 tons (preferably not over 8,000 tons). The platform has minimum processing facilities, that are sufficient only to collect and contain the produced hydrocarbons for transfer to another facility. The produced hydrocarbons are transferred to a loosely anchored seasurface structure 30 at the second station 14, which has hydrocarbon processing facilities. The particular structure 30 is a processing vessel which processes the hydrocarbons (e.g. removes sand and stones, and removes and disposes of gas) so they are ready for transport to a refinery. The stations 12, 14 may be spaced apart by many kilometers, and a conduit 32 is provided to connect them. The conduit has a major conduit portion 34 that extends along most of the distance between the stations, from the tree 26 on the platform 20. The second or buoy station 14 includes a buoy 40 that is anchored by a buoy anchor line 42 that extends down to a base 44 at the seafloor. The major portion 34 of the conduit extends to the buoy 40. The conduit also includes a flexible hose 46 that extends from the buoy 40 to the vessel 30.

The vessel 30 includes a hull 50 and a turret 52 rotatably mounted on the hull, with the particular turret 52 being shown mounted beyond the bow of the hull. The turret 52 (which drifts but does not weathervane) is anchored by several catenary anchor lines 54, 56, 58, and 60 that extend to the seafloor. The vessel can weathervane (point in different directions) and drift to a limited extent under the influence of winds, waves, and currents. Other loosely anchored seasurface structures will also drift because of the loose anchoring, but may not weathervane. The vessel may be dedicated so it does not move away from the second station, but offloads to other vessels. The flexible hose 46 is connected to the turret 52, which drifts with the vessel but which does not turn with it.

The major conduit portion 34 comprises a steel pipeline formed by numerous lengths of steel pipe. In one example, each steel pipe has a 12 inch (0.3 meter) inside diameter and a length of 40 feet (12 meters), with the pipes being connected in series. In the prior art, an end of such pipeline might be terminated at the base 44 where the buoy 40 was anchored, and a vertical pipe would extend up from the base to the buoy 40. Such an arrangement would necessitate at least one fluid connection at the seafloor, in addition to anchoring a vertical pipe to the base. Such connections are very difficult to make at great depths of a plurality of hundreds of meters, with the difficulty increasing at increasing depths.

Figure 2:
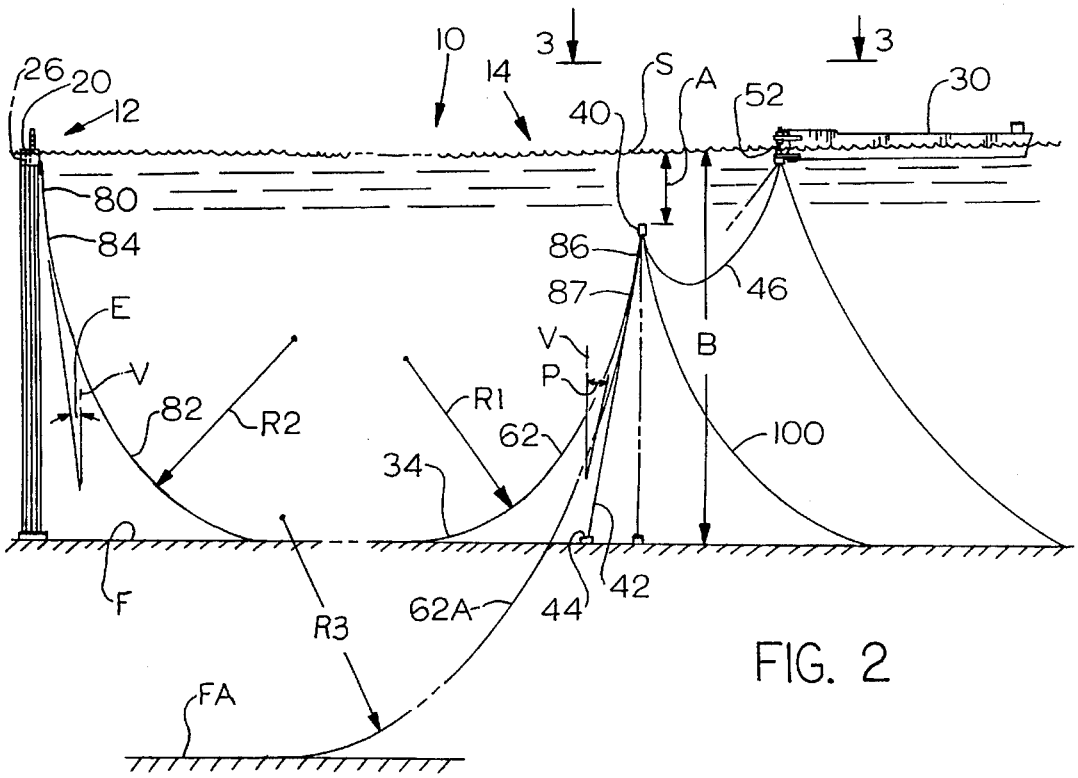
FIG. 2 is a side elevation view the system of FIG. 1, with the second arrangement being shown in solid lines.
Figure 4:
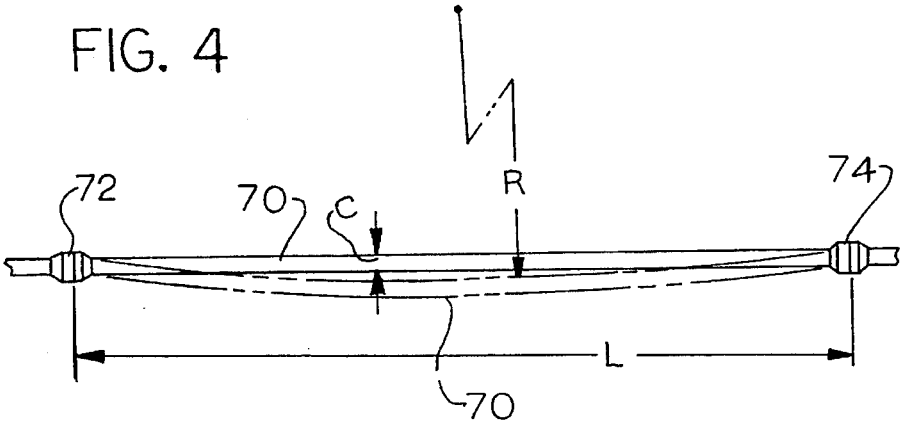
FIG. 4 is a partial view of the pipeline of FIG. 1, and showing, in phantom lines, maximum bending of the pipeline.

In accordance with the present invention, applicant lays the pipeline 34 so it extends in a J-curve 62 from the seafloor F to the buoy 40, where it connects to an end of the flexible hose 46. The J-curve 62 is carefully established to avoid bending the steel pipe beyond its elastic limit. As indicated in FIG. 2, the portion of the pipeline along the J-curve 62 has a predetermined minimum radius of curvature R1. R1 is preferably at least 500 times the outside diameter of the pipe for steel pipe, to assure that the pipe is bent only within its elastic limits. For a 12 inch inside diameter pipe (which may have an outside diameter of 13 to 14 inches, or about 0.3 meters), R1 is preferably at least 180 meters, or at least about 200 meters. FIG. 2 shows the opposite ends of the J-curve extending respectively substantially horizontally and substantially vertically. FIG. 4 shows one pipe 70 which has an inside diameter of 12 inches and which has a slightly greater outside diameter C of 13 to 14 inches, but with enlarged ends 72, 74 for connection to other similar pipes. The pipe has a length L of 40 feet (12 meters). Tests have shown that steel pipes of this type can resiliently bend by a maximum of about one degree per ten feet. As mentioned, such bending results in a bend with a radius of curvature R which is a minimum of about 200 meters, which results in deflection of the pipe to the configuration shown at 70A. The pipeline will have a long life if it is subjected to minimal changes in bending which could result in fatigue failure. The possibility of fatigue failure is minimized by reducing the amount of bending (increasing the radius of curvature of the bend) as well as by reducing changes in bending.

As shown in FIG. 2, the buoy 40 lies a considerable distance A below the sea surface S. The distance A is greater than the depth of the vessel 30 at the bottom of its turret 52, and of any other vessel likely to come along to unload hydrocarbons. The depth A is even greater than this amount to place the buoy below most wave action, with the distance A being a plurality of tens of meters and preferably being at least 100 meters. Due to the fact that the buoy 40 is below most wave action, it will be subjected to only moderate horizontal drift, so that the pipeline at the curve 62 will be subjected to minimal change in bending that would result in fatigue failure. The main buoy anchor line 42 extends primarily vertically, so the depth of the buoy changes very little. Thus, the layout of the steel pipeline in a large radius curve 62 that ends at the buoy 40, results in the pipeline being subjected to minimal changes in bending, so that it is likely to have a long lifetime of use.

The first end 80 of the conduit is connected to the tree 26 on the platform 20. The pipeline 34 extends in an additional J-curve 82 from its first end 80 to the seafloor F. Although the platform 20 lies at the sea surface where it is subjected to waves, its anchoring by the vertical tension lines 22 results in the virtual absence of vertical motion, and in only small horizontal motion, especially because almost all of the platform is submerged. As a result, there is only moderate change in bending of the pipeline whose end at 80 is connected to the tree 26. The upper portion 84 of the additional J-curve 82 is bent at a large radius of curvature R2 that is preferably greater than the minimum of 200 meters, so that slight change in bending does not have as deleterious effect in reducing its lifetime. The upper portion 84 of the J-curve of the pipeline preferably extends at an angle E of a plurality of degrees, but less than 20° from the vertical as indicated by line V. The first J-curve 62 similarly has an upper portion 87 that preferably extends at an angle P of a plurality of degrees but less than 20°.

Because of the need for the large radii of curvature R1, R2, that are each at least about 200 meters, and the need for the buoy 40 to lie at least about 100 meters below the sea surface, it can be appreciated that the present system 10 is useful only in waters having a depth B of more than 300 meters, and usually at least 500 meters. For a greater depth where the seafloor is indicated at FA, a somewhat greater radius of curvature R3 would be used for the pipeline to provide the J-curve 62A.

Figure 3:
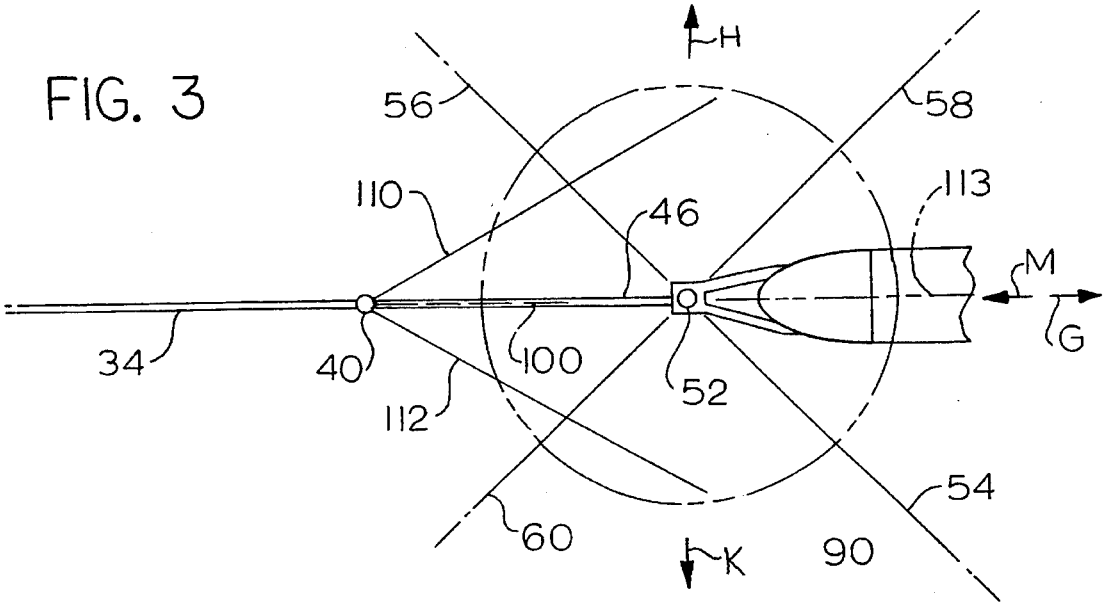
FIG. 3 is a view taken on the line 3—3 of FIG. 2, showing the range of movement of the vessel and showing a third buoy anchor arrangement.

As mentioned above, it is desirable that the buoy 40 undergo minimal horizontal movement. FIG. 3 shows that the turret 52 of the vessel is moored so it has a maximum drift which is within a drift circle 90, with the turret 52 being shown in its quiescent position (position assumed when there are no winds, waves or currents). The circle 90 represents the maximum deviation of the turret from its quiescent position, under the most severe storm conditions that the system is designed for. The buoy 40 is preferably placed outside the drift circle 90 to control bending of the flexible hose 46. However, it can be seen that if the turret should drift, this would cause some smaller but appreciable drift of the buoy 40. Referring again to FIG. 1, applicant prefers to provide a second buoy anchor line 100 that extends in a direction G away from the first platform 12. The second line 100 causes the buoy 40 to move a moderate amount in the direction G away from the position that it would assume in the absence of the second line 100. However, the second line 100 increases the stiffness of buoy mooring. As shown in FIG. 2, the second line 100 results in the main or first line 42 extending at an angle from the vertical. The stiffer system results in the buoy 40 moving horizontally by a smaller amount for a given change in horizontal load on it, which is applied by the flexible hose 46 when the turret 52 drifts. As mentioned above, by minimizing movement of the buoy 40, applicant minimizes changes in bending of the steel pipeline 34, which increases its life.

FIG. 3 shows another buoy anchor system, wherein third and fourth buoy anchor lines 110, 112 are provided, that extend with directional components H, K that are perpendicular to the direction G away from the first station. That is, the lines 110, 112 extend with directional components toward the quiescent position of the turret, but on opposite sides of an imaginary line 113 that extends between the buoy and the quiescent turret position. The additional lines 110, 112 provide stiffness to the system against movement in the directions H, K when the vessel turret 52 drifts in those directions, in addition to stiffness in directions G, M, away and toward the first station. With the presence of the third and fourth anchor lines 110, 112, applicant does not need his second anchor line 100.

The pipeline 34 can be established by vessels, with one vessel holding a large number of forty-foot lengths of steel pipe and connecting them in series while lowering them into the water. The end 80 (FIG. 2) of the pipeline 34 formed by the series-connected steel pipes, is held at the first platform 12 while the pipe-carrying vessel moves away from the first platform and while additional vessels connect cables to locations along the pipeline before portions of the pipeline are dropped from the pipe-carrying vessel. The additional vessels lower the pipeline onto the seafloor in a carefully controlled manner to establish the J-curve 82. The pipe-carrying vessel proceeds towards the second station 14 while laying pipes on the seafloor, and perhaps while receiving loads of additional pipes from transport vessels. When the pipe-carrying vessel approaches the second station, the additional vessels control the depth of the pipe to form it into the J-curve 62. Divers connect the second end 86 of the pipeline to an end of the flexible hose 46, in a connection that is supported by the buoy 40.

Additional distant stations can be similarly connected to the station 14. While FIGS. 1 and 2 show the first station 12 as a TLP, other types of stiffly moored stations can be used that include a floating structure that is anchored to prevent more than minimal drift (or which lies deep underwater to avoid drift-inducing forces) and whose produced hydrocarbons must be transported a long distance to an underwater buoy at another station. Also, while the figures show the second station 14 as including a vessel connected to the underwater buoy 40, other floating structures can be used, such as a buoy at the sea surface, which drifts but does not weathervane. The dimensions are given for a 12 inch pipe; for other sizes, the dimensions of the system would be proportional.

Thus, the invention provides an offshore fluid transfer system which makes maximum use of a steel pipeline, by extending it in a J-curve from the seafloor up to an underwater buoy where the pipeline is connected to a flexible hose that extends to a loosely anchored seasurface structure such as a vessel. The buoy lies at a moderate underwater depth, though closer to the sea surface than to the seafloor, and the pipeline is subjected to minimal changes in bending. By extending the pipeline up to the buoy, applicant avoids the need for fluid connections to be made at the seafloor. Applicant also avoids the need for a separate vertical pipe extending vertically to the buoy, and actually reduces the total length of the conduit by extending it in a curve instead of along the seafloor to a base and then directly vertically to a buoy. Applicant can minimize horizontal movement of the buoy by providing at least one additional buoy anchor line that extends with a directional component that is initially toward the quiescent turret position.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. An offshore fluid transfer system which includes a first station and a second or buoy station, where said buoy station includes a loosely anchored seasurface structure such as a vessel, a buoy, and at least one buoy anchor line that is anchored to the seafloor and that holds said buoy to a location that is closer to said seasurface structure than to said first station, with said buoy anchor line being short enough to hold said buoy at an underwater depth to minimize wave force on said buoy, and said system includes a conduit that extends between said first station and said seasurface structure to carry fluid between them, said conduit including a flexible hose which extends between said buoy and said seasurface structure and also including a major conduit portion that extends along most of the distance between said first station and said buoy, where said first station is further, as measured in a horizontal direction, from said buoy than the depth of said sea at either of said stations, characterized by:

said major conduit portion includes a long pipeline formed of steel pipes, which extends along said seafloor to near said buoy station, and which extends from the seafloor near said buoy station in a J-curve upwardly to said buoy, wherein said pipeline is free of fixed connection to the seafloor between said stations and said J-curve is unrestrained along more than half of the height between the seafloor and said buoy.

2. The system described in claim 1 wherein:

said seasurface structure has a quiescent position, and said at least one buoy anchor line includes a plurality of buoy anchor lines, including a first line that extends primarily vertically but with a directional component away from said quiescent position of said seasurface structure and a second line that extends from said buoy both downwardly and with a directional component toward said quiescent position of said seasurface structure, as seen in a plan view, to reduce numerous small movements of said buoy toward and away from said seasurface structure.

3. The system described in claim 2 wherein:

said plurality of buoy anchor line includes a third line that extends from said buoy both downwardly and with a directional component toward said quiescent position of said seasurface structure as seen in a plan view, with said second and third lines extending on opposite sides of an imaginary line extending through said buoy and through said quiescent position of said seasurface structure as seen in a plan view.

4. The system described in claim 1 wherein:

said steel pipe has a predetermined average outside diameter, and said long pipeline has a minimum radius of curvature (R1) at said J-curve, of at least 500 times said predetermined average diameter and with opposite ends of said J-curve extending respectively substantially horizontally and substantially vertically.

5. An offshore system comprising:

a tension leg platform station which includes a platform that floats at the sea surface and a plurality of tension lines that extend vertically from said platform to the seafloor;

a buoy station that includes a seasurface structure that floats at the sea surface but which can drift, and a buoy that floats at a depth of a plurality of tens of meters but closer to the sea surface than the seafloor, said platform being horizontally spaced from said buoy by a distance that is greater than the average depth of the sea;

a fluid conduit which connects said platform to said seasurface structure, including a flexible hose extending between said buoy and said seasurface structure, and a steel pipeline extending between said platform and said buoy;

said steel pipeline having a predetermined average outside diameter and extending in a first J-curve from substantially said platform to the seafloor, along said sea floor, and in a second J-curve from said seafloor to said buoy, with said steel pipeline being free of attachment to the seafloor in its extension between said J-curves.

6. A method for establishing a fluid connection between first and second offshore stations that are spaced by more than the depth of the sea at either station, where said second station includes a seasurface structure and a buoy, where said seasurface structure is anchored so it can drift by a limited amount from a quiescent position that is far from said first station, where said seasurface structure is connected by a flexible hose to said buoy, and where said buoy is held underwater at a substantially fixed location and at a depth where said buoy is closer to the sea surface than the seafloor, comprising:

laying a steel pipeline so the pipeline extends along the seafloor between said first station and a location spaced a plurality of hundreds of meters from said buoy, including laying a length of said pipeline from said location in a curve from the seafloor up to said buoy, and connecting an end of said pipeline to said flexible hose at said buoy, while leaving the entire length of said pipeline which extends along the seafloor and in said curve up to said buoy, unanchored and unconnected to the seafloor.

* * * * *